US008959964B2

(12) United States Patent
Hidaka et al.

(10) Patent No.: US 8,959,964 B2
(45) Date of Patent: Feb. 24, 2015

(54) OUTER HANDLE DEVICE FOR VEHICLE DOOR

(71) Applicant: Kabushiki Kaisha Honda Lock, Miyazaki-Shi, Miyazaki (JP)

(72) Inventors: Akinori Hidaka, Miyazaki (JP); Isao Todaka, Miyazaki (JP)

(73) Assignee: Kabushiki Kaisha Honda Lock, Miyazaki (JP)

( * ) Notice: Subject to any disclaimer, the term of this patent is extended or adjusted under 35 U.S.C. 154(b) by 0 days.

(21) Appl. No.: 14/069,495

(22) Filed: Nov. 1, 2013

(65) Prior Publication Data

US 2014/0123716 A1 May 8, 2014

(30) Foreign Application Priority Data

Nov. 8, 2012 (JP) ..... 2012-246563

(51) Int. Cl.

| | |
|---|---|
| ***E05B 13/00*** | (2006.01) |
| ***E05B 9/08*** | (2006.01) |
| ***E05B 85/16*** | (2014.01) |
| ***E05B 79/06*** | (2014.01) |

(52) U.S. Cl.

CPC ..... *E05B 85/16* (2013.01); *E05B 79/06* (2013.01); *Y10S 292/31* (2013.01)

USPC ..... 70/208; 70/210; 70/370; 70/451; 292/336.3; 292/DIG. 31

(58) Field of Classification Search

USPC ..... 70/208, 210, 370, 451, 466, 452; 292/336.3, DIG. 31, DIG. 64, DIG. 53

See application file for complete search history.

(56) References Cited

U.S. PATENT DOCUMENTS

| | | | | |
|---|---|---|---|---|
| 5,421,061 | A * | 6/1995 | Kolle et al. | 292/336.3 |
| 6,234,548 | B1 * | 5/2001 | Mittelbach et al. | 292/336.3 |
| 6,415,636 | B1 * | 7/2002 | Fukumoto et al. | 70/208 |
| 6,494,066 | B2 * | 12/2002 | Muneta | 70/208 |
| 6,588,813 | B1 * | 7/2003 | Marcarini et al. | 292/347 |
| 6,834,901 | B2 * | 12/2004 | Low | 296/1.02 |
| 7,146,832 | B2 * | 12/2006 | Mathofer | 70/208 |
| 7,603,881 | B2 * | 10/2009 | Yukihara et al. | 70/208 |
| 7,971,913 | B2 * | 7/2011 | Sunahara et al. | 292/336.3 |
| 8,104,314 | B2 * | 1/2012 | Mueller et al. | 70/370 |
| 8,248,205 | B2 * | 8/2012 | Schindler et al. | 340/5.62 |
| 8,562,039 | B2 * | 10/2013 | Ichikawa et al. | 292/336.3 |
| 8,746,758 | B2 * | 6/2014 | Savant et al. | 292/336.3 |

(Continued)

FOREIGN PATENT DOCUMENTS

JP 3486070 B2 1/2004

*Primary Examiner* — Lloyd Gall

(74) *Attorney, Agent, or Firm* — Carrier Blackman & Associates, P.C.; Joseph P. Carrier; Fulchand P. Shende

(57) ABSTRACT

An outer handle device is provided in which a cylinder lock placed adjacent to an opposite end portion of an outer handle and operatively connected with a latch mechanism is attached to an outer panel, the outer handle having one end portion pivotally supported by the panel. The device includes a base member sandwiched between an outer surface of the panel and the cylinder lock and a bracket which sandwiches the panel between the bracket and the base member, and is fastened to the cylinder lock. In a temporarily mounted state where the base member and the bracket are held by the panel by engagement of the bracket with the base member, the cylinder lock can be inserted from the outer side of the panel into the base member and the bracket.

2 Claims, 6 Drawing Sheets

(56) References Cited

U.S. PATENT DOCUMENTS

2002/0026817 A1* 3/2002 Greer ..... 70/370
2003/0011202 A1* 1/2003 Kwak ..... 292/336.3
2007/0182166 A1* 8/2007 Schindler et al. ..... 292/336.3
2008/0087061 A1* 4/2008 Kargilis et al. ..... 70/370
2008/0185850 A1* 8/2008 Takaya et al. ..... 292/336.3
2009/0256366 A1* 10/2009 Abe ..... 292/336.3

* cited by examiner

OUTER HANDLE DEVICE FOR VEHICLE DOOR

BACKGROUND OF THE INVENTION

1. Field of the Invention

The present invention relates to an outer handle device for a vehicle door in which an outer handle has one end portion pivotally supported by an outer panel of a door and has an opposite end portion provided with a connection arm portion configured to be connected to and move along with a latch mechanism, thereby allowing transmission of latch release operation power to the latch mechanism, the latch mechanism housed and fixed inside the door such that part of the latch mechanism faces an end wall located at a free end side of the door, and a cylinder lock is attached to the outer panel at a position adjacent to the opposite end portion of the outer handle in a longitudinal direction of the outer handle, the cylinder lock being configured to be connected to and move along with the latch mechanism to switch the latch mechanism between a lock state and an unlock state.

2. Description of the Related Art

There is known, from Japanese Patent No. 3486070, an outer handle device in which an outer handle has one end portion pivotally supported by an outer panel of a door, and a cylinder lock is attached to the outer panel via a base member, at a position adjacent to an opposite end portion of the outer handle in a longitudinal direction thereof.

SUMMARY OF THE INVENTION

The outer handle device disclosed in Japanese Patent No. 3486070 has a structure in which the cylinder lock is attached to the base member by being inserted into the base member from an inner side of the outer panel. However, in a configuration where the cylinder lock is configured to be connected to and move along with a latch mechanism, housed and fixed inside the door, to switch the latch mechanism between a lock state and an unlock state, the cylinder lock is, in some cases, placed at a position overlapping part of the latch mechanism in a view projected in a direction along a rotation axis of the cylinder lock. In such a case, if the latch mechanism is attached to the door before the cylinder lock is attached, it is difficult to assemble the cylinder lock from the inner side of the outer panel.

The present invention has been made in view of such a circumstance, and has an objective of providing an outer handle device for a vehicle door in which a cylinder lock can be inserted and attached from an outer side of an outer panel of a door with a simple attachment work and a simple attachment structure.

In order to achieve the object, according to a first feature of the present invention, there is provided an outer handle device for a vehicle door in which an outer handle has one end portion pivotally supported by an outer panel of a door and has an opposite end portion provided with a connection arm portion configured to be connected to and move along with a latch mechanism, thereby allowing transmission of latch release operation power to the latch mechanism, the latch mechanism housed and fixed inside the door such that part of the latch mechanism faces an end wall located at a free end side of the door, and a cylinder lock is attached to the outer panel at a position adjacent to the opposite end portion of the outer handle in a longitudinal direction of the outer handle, the cylinder lock being configured to be connected to and move along with the latch mechanism to switch the latch mechanism between a lock state and an unlock state, the outer handle device comprising: a base member which has a guide portion guiding movement of the connection arm portion and is sandwiched between an outer surface of the outer panel and the cylinder lock; and a bracket which is in contact with an inner surface of the outer panel while sandwiching the outer panel between the bracket and the base member, and is fastened to the cylinder lock, wherein the base member and the bracket are configured so that the base member and the bracket are allowed to be brought to a temporarily mounted state in which the base member and the bracket are held by the outer panel by engagement of the bracket, from an inner side of the outer panel, with the base member which is in contact with the outer surface of the outer panel, and the cylinder lock is allowed to be inserted from an outer side of the outer panel into the base member and the bracket which are in the temporarily mounted state, and the bracket is fastened to the cylinder lock inserted in the base member, from a side where the end wall of the door is located.

According to the present invention, the base member sandwiched between the outer surface of the outer panel and the cylinder lock and the bracket which is in contact with the inner surface of the outer panel while sandwiching the outer panel between the bracket and the base member, and is fastened to the cylinder lock can be brought to the temporarily mounted state in which the base member and the bracket are held by the outer panel by engagement of the bracket, from the inner side of the outer panel, with the base member which is in contact with the outer surface of the outer panel. The cylinder lock is inserted into the base member in the temporarily mounted state from the outer side of the outer panel, and the bracket is fastened to the cylinder lock inserted in the base member from the side where the end wall of the door is located. Thus, the cylinder lock can be inserted and attached from the outer side of the outer panel of the door with a simple attachment work and a simple attachment structure.

According to a second feature of the present invention, in addition to the first feature, there is provided the outer handle device for a vehicle door, further comprising, as a separate member from the base member having the guide portion, another base member being attached to the outer panel and having a handle support portion supporting the one end portion of the outer handle in such a manner that the one end portion of the outer handle is allowed to pivot.

The above and other objects, characteristics and advantages of the present invention will be clear from detailed descriptions of the preferred embodiment which will be provided below while referring to the attached drawings.

DESCRIPTION OF THE PREFERRED EMBODIMENT

Figure 1:
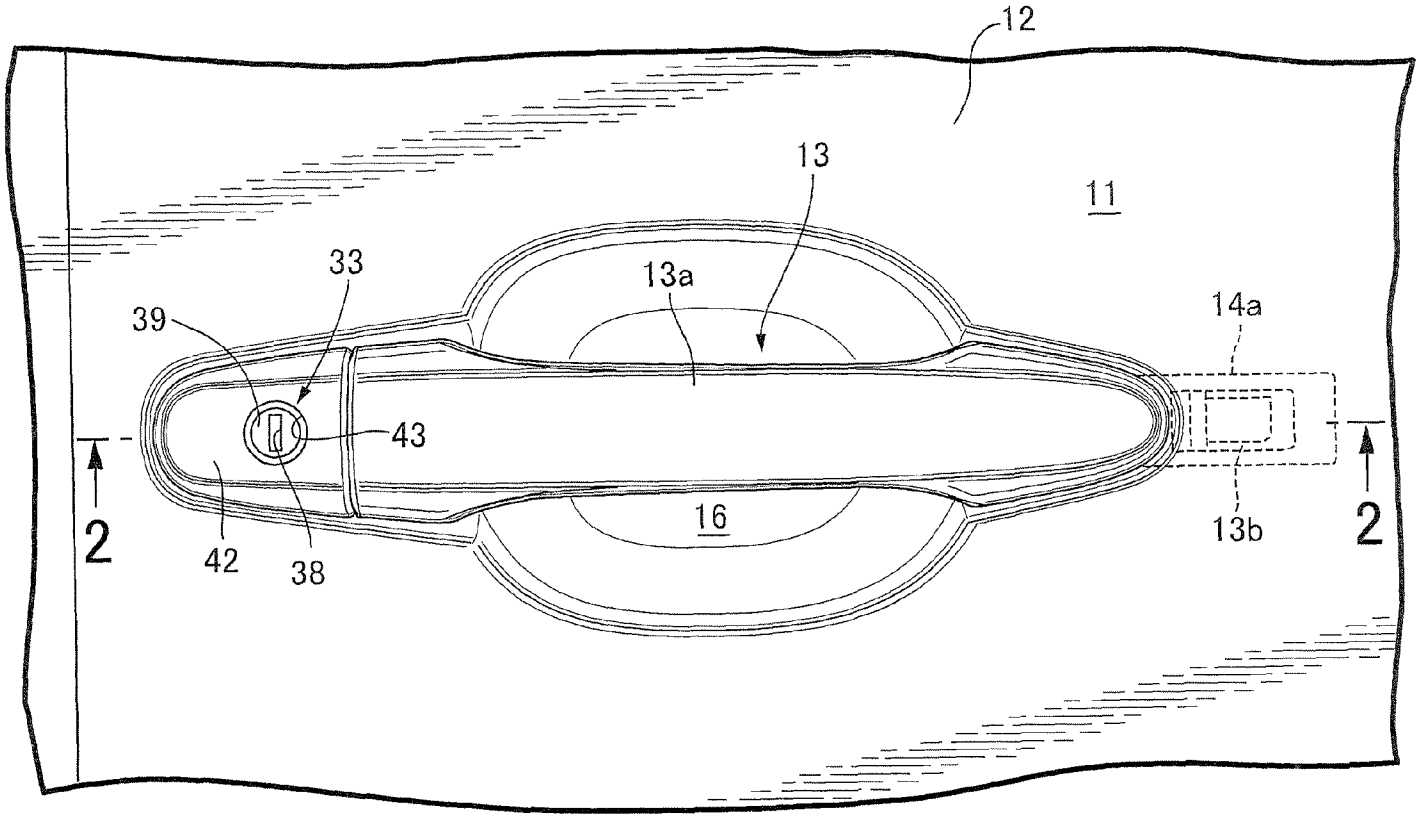
FIG. 1 is a side view of part of a door of a vehicle.

An embodiment of the present invention is described below with reference to FIGS. 1 to 6 attached hereto. First, in FIGS. 1 to 3, an outer handle 13 made of hard synthetic resin is pivotally supported by an outer panel 12 of a passenger door 11 of a passenger vehicle, for example. The outer handle 13 has: a grip portion 13*a* which can be gripped by a user of the vehicle, is located at an outer side of the outer panel 12, and extends in a front-rear direction of the vehicle (a left-right direction in FIG. 1); a support arm portion 13*b* integrally connected to one end portion of the grip portion 13*a* (a front end portion in the front-rear direction of the vehicle in this embodiment); and a connection arm portion 13*c* integrally connected to an opposite end portion of the grip portion 13*a* (a rear end portion in the front-rear direction of the vehicle in this embodiment). Further, a first base member 14 is attached to the outer panel 12 at the one end side of the outer handle 13, and a second base member 15 is attached to the outer panel 12 at the opposite end side of the outer handle 13.

The outer panel 12 is provided with a curved portion 12*a* bulging to an inner side to form an indentation 16 which allows the hand of a user of the vehicle to be inserted between the grip portion 13*a* of the outer handle 13 and the outer panel 12. At an outer surface, the outer panel 12 is provided with first and second attachment seats 17 and 18 at front and rear positions, respectively, sandwiching the curved portion 12*a* along the front-rear direction of the vehicle.

A first seat member 19 made of synthetic resin is interposed between the first base member 14 and the first attachment seat 17. The first base member 14 is integrally provided with a handle support portion 14*a* penetrating the first seat member 19 and the outer panel 12 and being inserted to the inner side of the outer panel 12. Further, a metallic nut 20 is embedded in a surface of the first base member 14, the surface facing the outer panel 12. The first base member 14 is attached to the first attachment seat 17 of the outer panel 12 by a bolt 21 inserted into the outer panel 12 from the inner side of the outer panel 12 and screwed tightly into the nut 20.

The support arm portion 13*b* is bent into a substantial L shape and is integrally connected to the one end portion of the grip portion 13*a*. The first attachment seat 17 of the outer panel 12, the first seal member 19 and the first base member 14 are each provided with a void 22 for inserting the support arm portion 13*b* to the inner side of the outer panel 12. The support arm portion 13*b* placed inside the handle support portion 14*a* is pivotally supported by the handle support portion 14*a* via a support pin 23. In other words, the one end portion of the outer handle 13 is pivotally supported by the outer panel 12 via the first base member 14.

Figure 4:
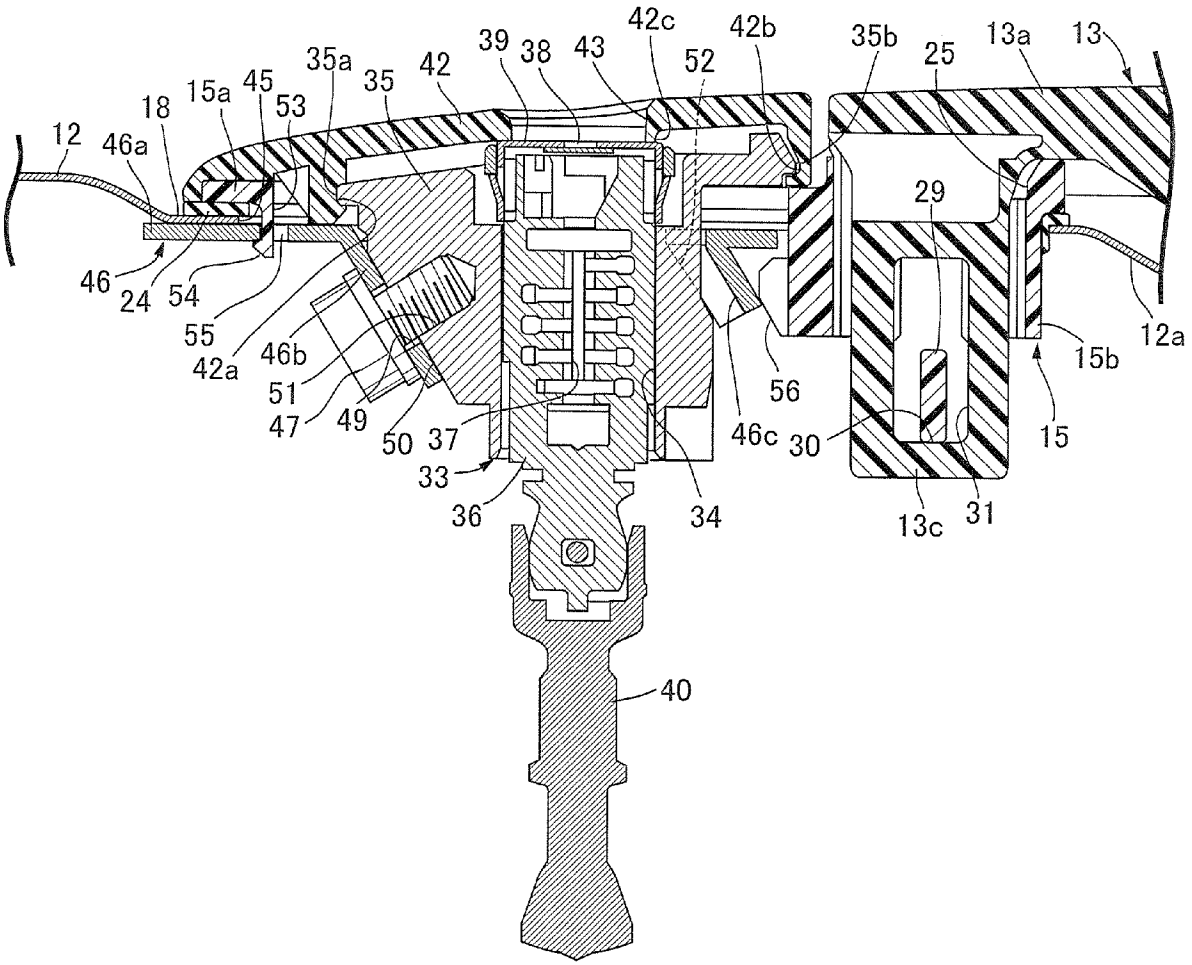
FIG. 4 is an enlarged view of a main portion of FIG. 2.

Also referring to FIG. 4, the second base member 15 is made of hard synthetic resin, and integrally has: a base member main portion 15*a* placed at an outer side of the second attachment seat 18 of the outer panel 12; and a guide portion 15*b* extending from the base member main portion 15*a* into the inner side of the outer panel 12 in such a manner as to guide the connection arm portion 13*c* connected to the opposite end portion of the grip portion 13*a* of the outer handle 13 substantially perpendicularly. The second base member 15 is attached to the outer panel 12. A second seal member 24 made of an elastic material such as rubber, synthetic resin or the like is interposed between the base member main portion 15*a* and the second attachment seat 18.

The base member main portion 15*a* of the second base member 15 is provided with a rectangular insertion hole 25 into which the connection arm portion 13*c* is inserted. The guide portion 15*b* is formed into a square tubular shape which is continuous with the insertion hole 25.

Figure 2:
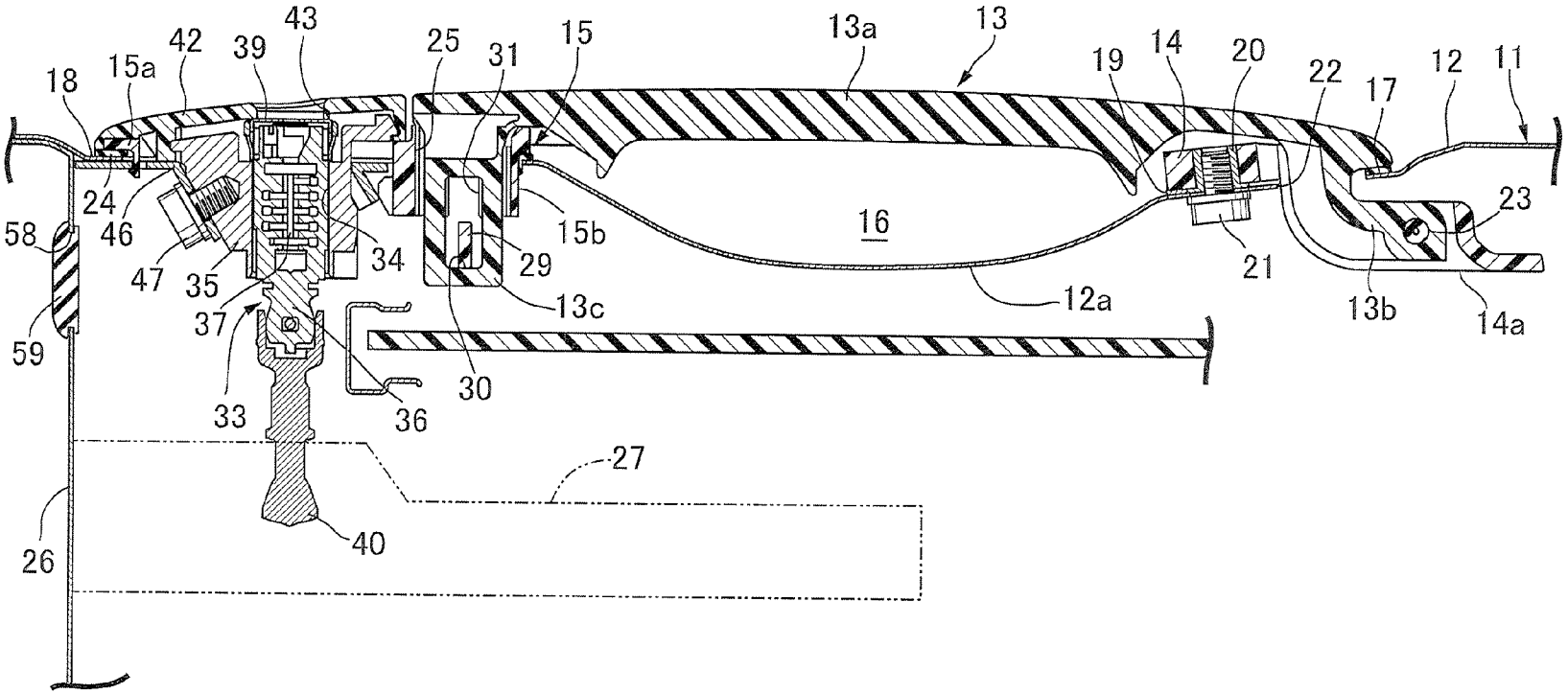
FIG. 2 is a sectional view taken along line 2-2 in FIG. 1.
Figure 3:
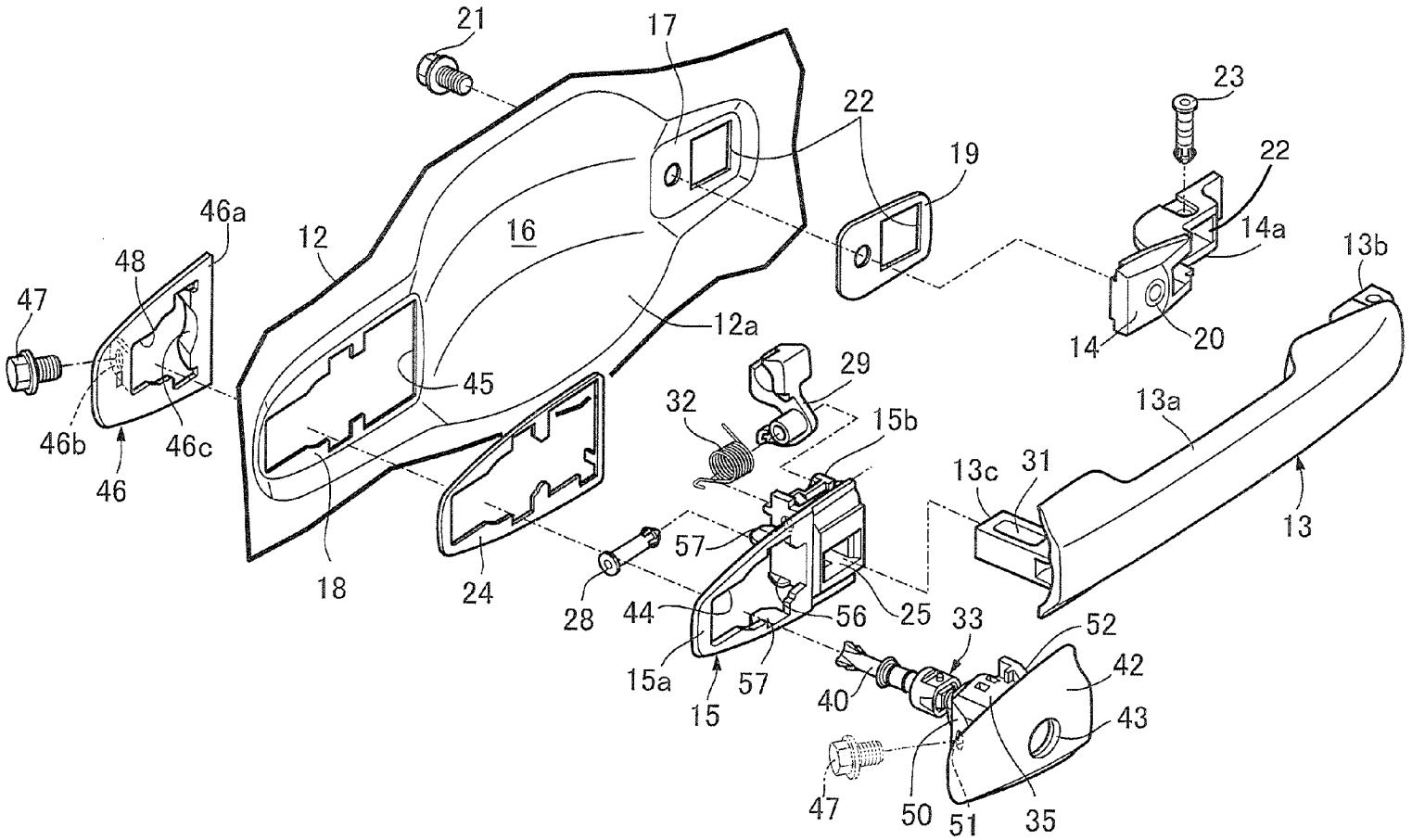
FIG. 3 is an exploded perspective view of an outer handle device.

As shown in FIG. 2, a latch mechanism 27 is housed and fixed inside the door 11, part of the latch mechanism 27 facing an end wall 26 of the door 11 located at a free end side of the door 11. The connection arm portion 13*c* is configured to be connected to and move along with the latch mechanism 27, allowing transmission of latch release operation power to the latch mechanism 27.

A lever 29 is pivotally supported by the guide portion 15*b* of the second base member 15 with a spindle 28 extending in the front-rear direction of the vehicle which is orthogonal to a rotation axis of the outer handle 13. The lever 29 engages and is in contact with a contact surface 30 provided to the connection arm portion 13*c*.

Part of the lever 29 is inserted into an opening portion 31 provided to the connection arm portion 13*c* of the outer handle 13. The contact surface 30 is formed at one sidewall of the opening portion 31 at a tip end side of the connection arm portion 13*c* and faces the outer side. Inside the opening portion 31, the lever 29 is in contact with the contact surface 30. Moreover, a spring 32 is provided between the lever 29 and the guide portion 15*b*, the spring 32 biasing the lever 29 toward the contact surface 30.

In other words, the lever 29 turns about an axis of the spindle 28 in accordance with a rotational operation on the outer handle 13, and operational power produced by an operation on the outer handle 13 is mechanically transmitted to the latch mechanism 27 via power transmission members such as a rod connected at one end to the lever 29, or the like.

Further, a cylinder lock 33 switching the latch mechanism 27 between a lock state and an unlock state is attached to the outer panel 12 at a position overlapping part of the latch mechanism 27 in a view projected in a direction along a rotation axis of the cylinder lock 33 and being adjacent to the opposite end portion of the outer handle 13 in a longitudinal direction of the outer handle 13.

The cylinder lock 33 includes a cylinder body 35 having a cylinder hole 34, and a rotor 36 rotatably fitted into the cylinder hole 34 with the position of an axis of the rotor 36 being fixed. A cap 39 having a key insertion hole 38 corresponding to a key hole 37, having a bottom, provided to the rotor 36 is fitted onto an outer end portion of the rotor 36. A power transmission shaft 40 is connected to an inner end portion of the rotor 36 at a portion protruding from the cylinder body 35. As shown in FIG. 2, the power transmission shaft 40 is connected to the latch mechanism 27 with the cylinder lock 33 being attached to the outer panel 12.

A cover 42 is attached to and covers, from the outer side, the cylinder body 35. An engagement projection portion 35*a* of the cylinder body 35 projecting at a rear edge of an outer end portion of the cylinder body 35 engages with a locking indentation portion 42*a* provided to the cover 42, and another engagement projecting portion 35*b* of the cylinder body 35 provided at an inner edge of a front end portion of the cylinder body 35 engages with another locking indentation portion 42*b* provided to the cover 42 at a front edge portion of the cover 42.

The cover 42 is formed into such a shape that is smoothly continuous with the opposite end portion of the outer handle 13 in a non-operation state when the cover 42 is attached to the cylinder lock 33 attached to the outer panel 12. The cover 42 is integrally provided with a tube portion 42*c* slightly projecting to the inner side. The tube portion 42*c* of the cover 42 is arranged on to the cap 39 of the cylinder lock 33. The tube portion 42*c* forms an insertion hole 43 for inserting a mechanical key (not shown) into the cylinder lock 33.

A cylinder body insertion hole 44 for inserting the cylinder body 35 of the cylinder lock 33 is formed at the base member main portion 15*a* of the second base member 15 at a position rearward of the insertion hole 25. The second attachment seat 18 of the outer panel 12 is provided with a void 45 into which the guide portion 15*b* inserted in the insertion hole 25 and part of the cylinder body 35 inserted in the cylinder body insertion hole 44 are inserted. The second seal member 24 is formed into such a shape surrounding the void 45.

A bracket 46 is in contact with an inner surface of the outer panel 12, and the outer panel 12 is sandwiched between the bracket 46 and the base member main portion 15*a* of the second base member 15. The cylinder body 35 of the cylinder lock 33 is fastened to the bracket 46 with a bolt 47.

The bracket 46 integrally has: a plate-shaped bracket main portion 46*a* having an opening portion 48 into which the cylinder body 35 of the cylinder lock 33 can be inserted and which is in contact with the inner surface of the outer panel 12; an attachment plate portion 46*b* being integrally connected to the bracket main portion 46*a* and extending from a rear end edge of the opening portion 48 to the inner side of the outer panel 12; and an engagement plate portion 46*c* being integrally connected to the bracket main portion 46*a* and extending from a front end edge of the opening portion 48 to the inner side of the outer panel 12 while facing the attachment plate portion 46*b*.

The attachment plate portion 46*b* is connected to the bracket main portion 46*a* while inclining in such a manner that the more the attachment plate portion 46*b* extends to the inner side of the outer panel 12, the more it approaches a center axis of the cylinder hole 34 of the cylinder lock 33 being attached to the outer panel 12. The attachment plate portion 46*b* is provided with a bolt insertion hole 49.

A flat attachment surface 50 to be in contact with the attachment plate portion 46*b* is formed at an outer periphery of the cylinder body 35 of the cylinder lock 33, the attachment surface 50 inclining in such a manner that the more the flat attachment surface 50 extends to the inner side of the outer panel 12, the more it approaches the center axis of the cylinder hole 34 of the cylinder lock 33. The attachment surface 50 is provided with a screw hole 51 having a bottom. The cylinder body 35 is fastened to the bracket 46 by the bolt 47 inserted into the bolt insertion hole 49 and tightly screwed into the screw hole 51.

Paired inclined surfaces 52 parallel to the attachment surface 50 are formed at the outer periphery of the cylinder body 35 at a portion opposite from the attachment surface 50 with respect to the cylinder hole 34. The engagement plate portion 46*c* of the bracket 46 is formed into such a shape as to extend parallel to the attachment plate portion 46*b* so that the engagement plate portion 46*c* may come into sliding contact with the inclined surfaces 52 when the attachment surface 50 of the cylinder body 35 is brought into sliding contact with the attachment plate portion 46*b* of the bracket 46.

The bracket 46 and the second base member 15 are configured to be able to be brought to a temporarily mounted state in which the second base member 15 and the bracket 46 are held by the outer panel 12 of the door 11 by the bracket 46 engaging, from the inner side of the outer panel 12, with the second base member 15 whose base member main portion 15*a* is in contact with an outer surface of the outer panel 12.

Specifically, the bracket main portion 46*a* is provided with an engagement hole 55 with which an engagement claw 54 engages in a snapping manner, with the bracket main portion 46*a* being in contact with the inner surface of the outer panel 12. The engagement claw 54 is provided at a tip end of a projecting portion 53, and the projecting portion 53 is provided to the base member main portion 15*a* of the second base member 15. Paired locking protrusions 56 formed to be sandwiched between a front portion of the bracket main portion 46*a* and the engagement plate portion 46*c* project integrally from an outer surface of the guide portion 15*b* of the second base member 15. The second base member 15 is integrally provided with insertion projection portions 57 to be inserted to an upper portion and a lower portion of the opening portion 48 of the bracket 46, the insertion projection portions 57 projecting from an upper portion side edge and a lower portion side edge, respectively, of the cylinder body insertion hole 44 of the second base member 15.

The cylinder body 35 of the cylinder lock 33 is inserted from the outer side of the outer panel 12 into the cylinder body insertion hole 44 of the second base member 15, the void 45 of the outer panel 12, and the opening portion 48 of the bracket 46, with the second base member 15 and the bracket 46 being in the temporarily mounted state in which they are held by the outer panel 12 of the door 11. The bracket 46 is fastened by the bolt 47 rotationally operated, through a bolt operation hole 58 provided to the end wall 26 of the door 11, to be screwed into the cylinder body 35 of the cylinder lock 33 inserted in the second base member 15. After the rotational operation on the bolt 47, the bolt insertion hole 58 is closed with a lid member 59 fitted detachably to the end wall 26.

Figure 5:
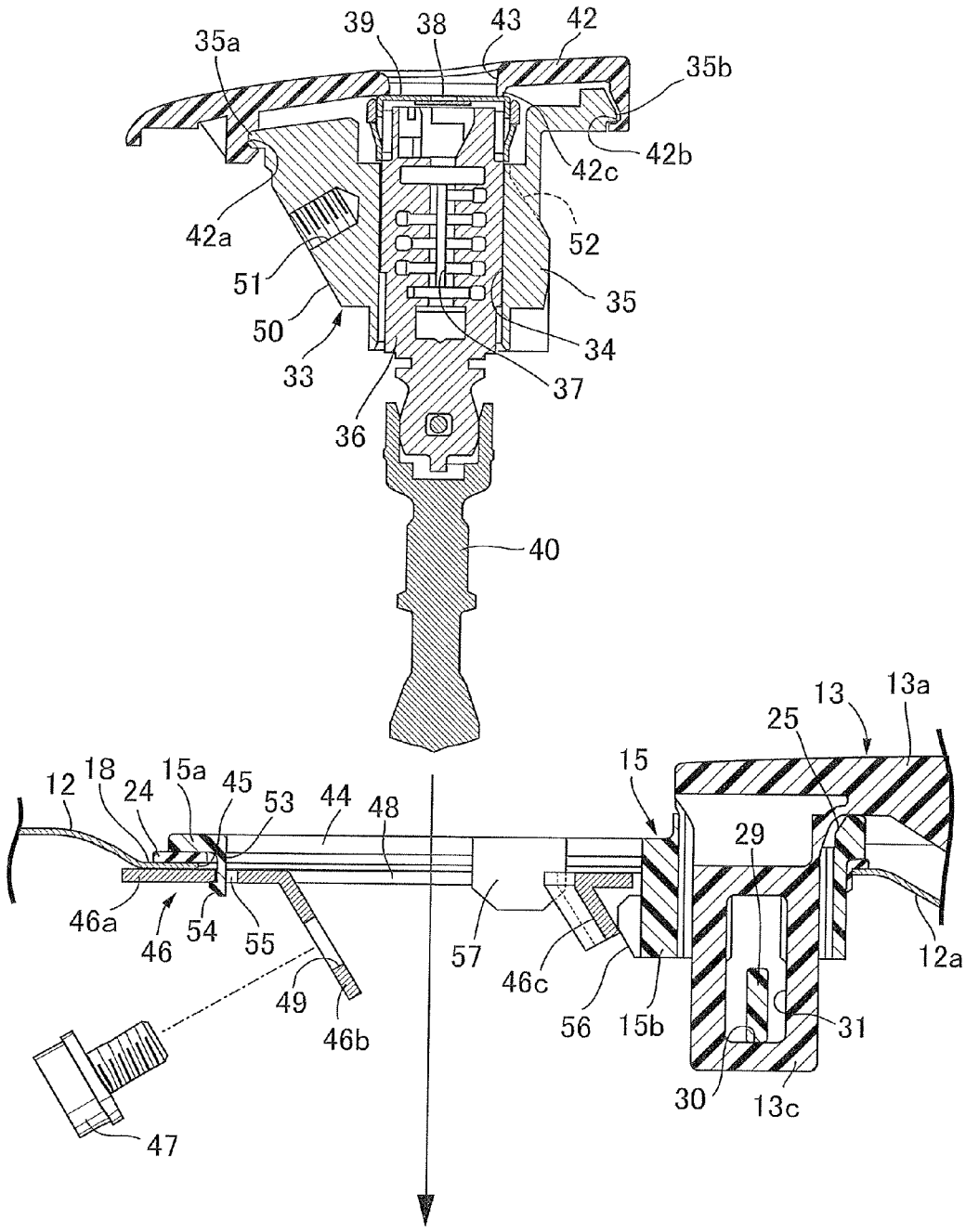
FIG. 5 is a sectional view corresponding to FIG. 4, in which a second base member and a bracket are temporarily mounted to and held by an outer panel.

As shown in FIG. 5, to assemble the outer handle 13 and the cylinder lock 33 to the outer panel 12, first, the second base member 15 is brought into contact with the outer surface of the outer panel 12. In this embodiment, the connection arm portion 13*c* of the outer handle 13 is inserted into the guide portion 15*b* of the second base member 15. Part of the lever 29 supported on the second base member 15 side is inserted into the opening portion 31 of the connection arm portion 13*c*. The support arm portion 13*b* at the one end portion of the outer handle 13 is pivotally supported by the handle support portion 14*a* of the first base member 14. Thus, the first base member 14 is fixed to the outer panel 12 while being mounted to the outer handle 13, and the second base member 15 is brought into contact with the outer surface of the outer panel 12.

The bracket 46 is engaged, from the inner side of the outer panel 12, with the second base member 15 in contact with the outer surface of the outer panel 12, and thus the second base member 15 and the bracket 46 are brought to the temporarily mounted state in which they are held by the outer panel 12 of the door 11.

Then, the cylinder lock 33 having the cover 42 attached to the cylinder body 35 thereof is inserted from the outer side of the outer panel 12 into the second base member 15 and the bracket 46 which are in the temporarily mounted state.

Figure 6:
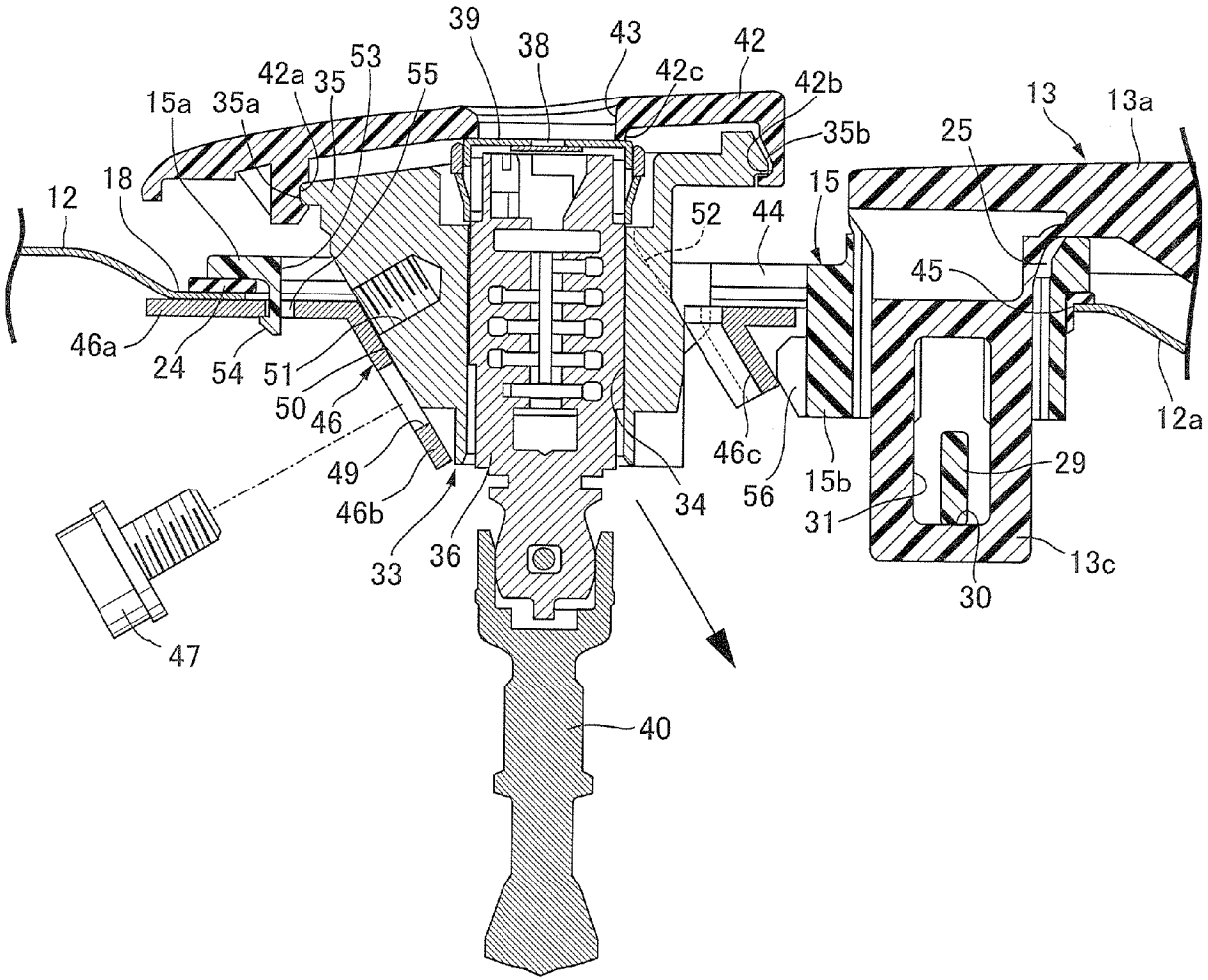
FIG. 6 is a sectional view corresponding to FIG. 4, in which a cylinder lock is inserted.

Next, as shown in FIG. 6, after the cylinder lock 33 is inserted into the second base member 15 and the bracket 46 until the attachment surface 50 of the cylinder body 35 of the cylinder lock 33 comes into contact with the attachment plate portion 46*b* of the bracket 46, the cylinder lock 33 is further inserted toward the inner side of the outer panel 12, bringing the attachment surface 50 thereof into sliding contact with the engagement plate portion 46*c* and also bringing the inclined surfaces 52 thereof into sliding contact with the engagement plate portion 46*c*. The cylinder lock 33 is inserted until the cylinder lock 33 reaches a position at which the screw hole 51 coincides with the bolt insertion hole 49. In that state, the power transmission shaft 40 continuous with the rotor 36 of the cylinder lock 33 is connected to the latch mechanism 27, and the cylinder body 35 is fastened to the bracket 46 with the bolt 47.

Effects of this embodiment are described next. The one end portion of the outer handle 13 is pivotally supported at the outer panel 12 of the door 11 via the first base member 14, and the cylinder lock 33 is attached to the outer panel 12 at a position adjacent to the opposite end portion of the outer handle 13. The second base member 15 which has the guide portion 15*b* for guiding movement of the connection arm portion 13*c* of the outer handle 13 at the opposite end portion and which is sandwiched between the outer surface of the outer panel 12 and the cylinder lock 33, and the bracket 46 in contact with the inner surface of the outer panel 12 which is sandwiched between the bracket 46 and the second base member 15 and fastened to the bracket 46 are configured as follows. They can be brought to the temporarily mounted state in which the second base member 15 and the bracket 46 are held by the outer panel 12 by the bracket 46 engaging, from the inner side of the outer panel 12, with the second base member 15 in contact with the outer surface of the outer panel 12. In addition, the second base member 15 and the bracket 46 allow the cylinder lock 33 to be inserted from the outer side of the outer panel 12 into the second base member 15 and the bracket 46 which are in the temporarily mounted state. The bracket 46 is fastened to the cylinder body 35 of the cylinder lock 33 inserted in the second base member 15, from the side where the end wall 26 of the door 11 is located. Thus, the cylinder lock 33 can be inserted and attached from the outer side of the outer panel 12 of the door 11 with a simple attachment work and a simple attachment structure.

The embodiment of the present invention has been described above, but the present invention is not limited to the above embodiment. Various design changes can be made without departing from the present invention described in the claims.

For example, in the above embodiment, the cylinder lock 33 is placed at a position overlapping part of the latch mechanism 27 in a view projected in the direction along the rotation axis of the cylinder lock 33. However, the present invention is also applicable to a case where the cylinder lock 33 is placed away from the latch mechanism 27 in the projected view. Moreover, the cylinder lock 33 may be connected to the latch mechanism 27 so as to move along therewith, after the completion of mounting the cylinder lock 33.

In addition, in the above embodiment, the first base member 14 supporting the one end portion of the outer handle 13 in such a manner that the one end portion is allowed to pivot and the second base member 15 having the guide portion guiding the connection arm portion 13*c* of the outer handle 13 are separate members. However, the present invention is also applicable to a case of using a base member integrally having a portion supporting the one end portion of the outer handle 13 and a portion guiding the connection arm portion 13*c* of the outer handle 13 at the opposite end portion.

What is claimed is:

1. An outer handle device for a vehicle door, said vehicle door comprising an outer panel, a free end side and an end wall located at the free end side;

said outer handle device comprising:

a latch mechanism to be housed and fixed inside the vehicle door such that a part of the latch mechanism is to face the end wall located at the free end side of the door, and an outer handle having one end portion to be pivotally supported by said outer panel of the vehicle door; and an opposite end portion provided with a connection arm portion configured to be connected to and move along with the latch mechanism, thereby allowing transmission of latch release operation power to the latch mechanism, and a cylinder lock to be attached to the outer panel at a position adjacent to the opposite end portion of the outer handle in a longitudinal direction of the outer handle, the cylinder lock being configured to be connected to and move along with the latch mechanism to switch the latch mechanism between a lock state and an unlock state, the outer handle device further comprising:

a base member having a guide portion for guiding movement of the connection arm portion, said base member is to be sandwiched between an outer surface of the outer panel and the cylinder lock; and a bracket which is to be in contact with an inner surface of the outer panel while sandwiching the outer panel between the bracket and the base member, and is fastened to the cylinder lock, wherein the base member and the bracket are configured so that the base member and the bracket are brought to a temporarily mounted state in which the base member and the bracket are to be held by the outer panel by engagement of the bracket, from an inner side of the outer panel, with the base member which is to be positioned near the outer surface of the outer panel, and the cylinder lock is inserted from an outer side of the outer panel into the base member and the bracket which are in the temporarily mounted state, the bracket is fastened to the cylinder lock inserted in the base member, from a side where the end wall of the door is to be located; and wherein the bracket comprises a plate-shaped bracket main portion having an opening portion into which the cylinder lock is inserted and which is to be in contact with the inner surface of the outer panel, an attachment plate portion connected to the bracket main portion and extending from the opening portion to the inner side of the outer panel, and an engagement plate portion connected to the bracket main portion and extending from the opening portion to the inner side of the outer panel while facing the attachment plate portion.

2. The outer handle device for a vehicle door according to claim 1, further comprising another base member to be attached to the outer panel and having a handle support portion for supporting the one end portion of the outer handle in such a manner that the one end portion of the outer handle is to be allowed to pivot.

* * * * *